United States Patent [19]

Weisgerber

[11] Patent Number: 4,561,181

[45] Date of Patent: Dec. 31, 1985

[54] REPLACEABLE NOSE ASSEMBLY FOR CHAIN SAW GUIDE BAR

[75] Inventor: David J. Weisgerber, Gresham, Oreg.

[73] Assignee: Omark Industries, Inc., Portland, Oreg.

[21] Appl. No.: 421,876

[22] Filed: Sep. 23, 1982

[51] Int. Cl.[4] ..... B27B 17/04

[52] U.S. Cl. ..... 30/387; 411/339

[58] Field of Search ..... 30/387, 383–386; 83/826, 814; 29/463, 509, 520, 526 R; 411/32, 44, 45, 54, 56, 338, 339

[56] References Cited

U.S. PATENT DOCUMENTS

| | | | |
|---|---|---|---|
| 1,460,076 | 6/1923 | Oldroyd . | |
| 2,316,997 | 4/1943 | Smith . | |
| 2,432,567 | 12/1947 | Forrest . | |
| 2,693,206 | 11/1954 | Anttonen . | |
| 2,838,833 | 6/1958 | Richardson | 29/463 |
| 2,888,964 | 6/1959 | Mall . | |
| 3,147,525 | 9/1964 | Texier | 411/44 |
| 3,176,733 | 4/1965 | Dobbertin . | |
| 3,762,047 | 10/1973 | Scott-Jackson | 30/385 |
| 4,138,813 | 2/1979 | Harada et al. | 30/387 |
| 4,259,783 | 4/1981 | Scott-Jackson et al. | 30/384 |

OTHER PUBLICATIONS

AB Partner Brochures, Nos. 782180, 782120.

*Primary Examiner*—Douglas D. Watts
*Attorney, Agent, or Firm*—John W. Stuart

[57] ABSTRACT

A guide bar has a main body section and a separate nose section releasably secured thereto. The main body section has a pair of opposed recesses in opposite faces thereof and an opening in said recesses to form a flange. The nose section includes a pair of opposed plates, at least one of the plates having a central portion deformed laterally toward the other plate. The plates are secured together in the region of lateral deformation with edge margins thereof spaced apart to provide a drive chain-receiving groove generally aligned with a similar groove in the peripheral edge of the main body section. The body and nose sections are secured together by a hub and expander member assembly which extends into substantially aligned apertures in the body section and nose section. Edge margins of the recesses on the body section and nose section are disposed at diverging angles progressing toward the nose end of the bar to aid in alignment and securing of the body and nose section.

8 Claims, 6 Drawing Figures

REPLACEABLE NOSE ASSEMBLY FOR CHAIN SAW GUIDE BAR

BACKGROUND AND SUMMARY OF THE INVENTION

This invention relates to a guide bar for a saw chain on a chain saw and more specifically to a guide bar having a replaceable nose section.

A guide bar for a chain saw supports a saw chain that travels at high speeds while subjected to cutting loads. A considerable force is required to pull the chain around the bar and causes severe wear at the nose of the bar. Also, it is common that bars may be damaged at the nose portion. Accordingly, this wearing and/or damage at the nose of the bar often determines the reasonable life of the typical guide bar.

The bar is a fairly expensive item to the chain saw user. Thus, there have been a number of attempts to design guide bars having replaceable nose sections which can multiply the usable life of the main portion of the bar and substantially reduce the user's costs.

A number of disadvantages have been experienced in prior bars with replaceable nose sections. To obtain sufficient rigidity in the interconnection between the main body section and the nose section of such a bar, it is desirable to provide a portion of one section of the bar which slips into or onto a portion of the other section. This has generally required either that both sections be machined to provide such interfitting relationship or that one portion be provided with additional spacer elements between parts to provide a spacing therebetween.

A general object of the present invention is to provide a novel guide bar in which a sliding interconnection, or fit, can be provided with a minimum of machining or spacing elements required. More specifically, the invention provides a bar with a nose section which consists of a pair of opposed, facing plates, at least one of the plates having a central portion deformed laterally toward the other of the plates from the plane of the remainder portions thereof. The two plates are secured together in the region of deformation whereby peripheral edge margins of the plates are spaced apart to define a chain-receiving groove therein. The nose section has rearwardly extending tongue portions also with peripheral edge margins spaced apart by the deformation of central portions of the plates, which spaced portions of the tongues may slide onto a flange formed in the main body section of the bar to provide alignment and a rigid interconnection therebetween.

A further object of the present invention is to provide such a novel bar in which recesses are provided in opposed faces of the main body section of the bar. These recesses have edge margins which diverge on progressing forwardly in the bar and the tongue portions of the nose section have complementary diverging edge margins which cooperate with the diverging edge margins of the recesses to provide desired alignment between the sections.

A still further object of the present invention is to provide such a novel guide bar in which generally aligned apertures are defined in the tongue portions of the plates of the nose section and a portion of the main body section of the bar for receiving a securing member therebetween. The securing member may be a combination hub unit of a shape to fit in the apertures and having a bore therethrough, with an expander member sized for driving into the bore in the hub member for expanding the same into the apertures and holding it securely therein. The apertures in the nose section may be slightly offset longitudinally of the bar from the aperture in the body section. On expansion of the hub the sections are drawn tightly together.

DRAWINGS

These and other objects and advantages will become more fully apparent when the following description is read in conjunction with the drawings wherein.

DETAILED DESCRIPTION OF AN EMBODIMENT OF THE INVENTION

Figure 1:
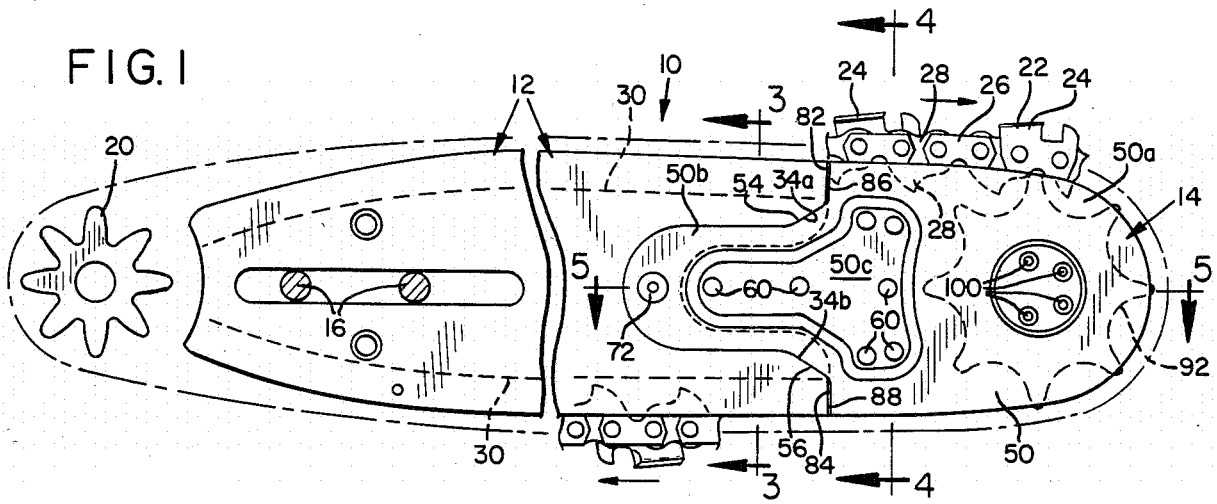
FIG. 1 is a side elevation view of a guide bar with replaceable nose section constructed according to an embodiment of the invention.

Referring to the drawings, and first more specifically to FIG. 1, at 10 is indicated generally a guide bar assembly constructed according to an embodiment of the invention. The assembly includes an elongate, substantially planar main body section 12 and a removable nose section 14. The guide bar is adapted to be mounted at its rear end by mounting lugs 16 to a chain saw motor housing (not shown). A drive sprocket 20 is rotated by the drive shaft of the chain saw to move the saw chain 22 around the guide bar 10.

The saw chain includes a plurality of pivotally interconnected cutters 24, tie straps 26, and drive links 28. The drive links have depending tangs **28*a* which rest in and are slidably moveable along grooves 30 in the peripheral edge margins of the guide bar. As will be described in greater detail below, nose section 14 also provides a drive tang-receiving groove extending about its peripheral edge margin which is substantially aligned with grooves 30** when the guide bar is fully assembled.

Figure 2:
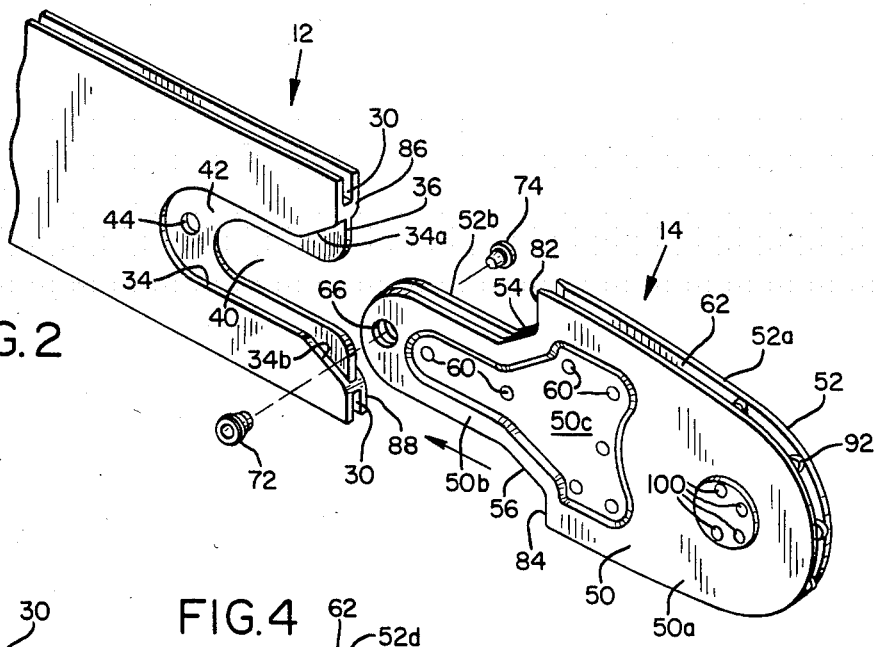
FIG. 2 is a perspective view of the nose end of the guide bar with a nose section ready to be assembled to the main body section.

Referring to FIG. 2, the outer end of main bar section 12 has a pair of mirror-image, U-shaped recesses 34, 36 defined in opposite sides thereof. As is seen in FIGS. 1 and 2, the opposed peripheral edge margins of the recesses illustrated at **34*a*, 34*b* for recess 34 diverge on progressing toward the outer, or forward, end of the body section. Peripheral edge margins of recess 36** similarly diverge.

A U-shaped opening 40 extends inwardly from the outer end of the body section of the bar. A central portion of the bar intermediate recesses 34, 36 and extending about opening 40 defines a flange 42 paralleling the plane of the body intermediate opposed faces of the bar. An aperture, or bore, 44 extends through flange 42.

Nose section 14 comprises a pair of opposed, facing, mirror-image plates 50, 52. Each has a nose portion **50*a*, 52*a* and a rearwardly extending tongue portion 50*b*, 52*b*, respectively. Each nose portion has a width substantially equal to the width of the outer end of main body section 12. The tongue portions are narrower than the nose portion, and have configurations complementing the recesses 34, 36 in opposite faces of the bar. Edge margin portions of the plates noted at 54, 56 intermediate the tongue and nose portions diverge on progressing forwardly at an angle complementary to the angle of edge margin portions 34***a*, 34*b* on the main body portion. However, edge margins 54, 56 are slightly wider than the spacing between edge margins 34*a*, 34*b*.

Central portions 50*c*, 52*c* of plates 50, 52 spaced inwardly from edge margins of the plates are embossed, or deformed, from the plane of remainder portions of the nose section inwardly, or laterally, toward the other plate. The plates are joined together with their embossed central portions 50*c*, 52*c* in abutting facing relationship, as illustrated in FIGS. 3, 4 and 5, and are secured together by a plurality of spot welds 60.

Figure 4:
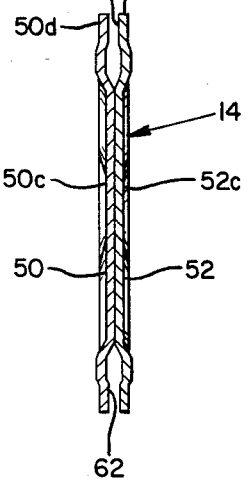
FIG. 4 is a cross-sectional view taken generally along the line 4—4 in FIG. 1.
Figure 5:
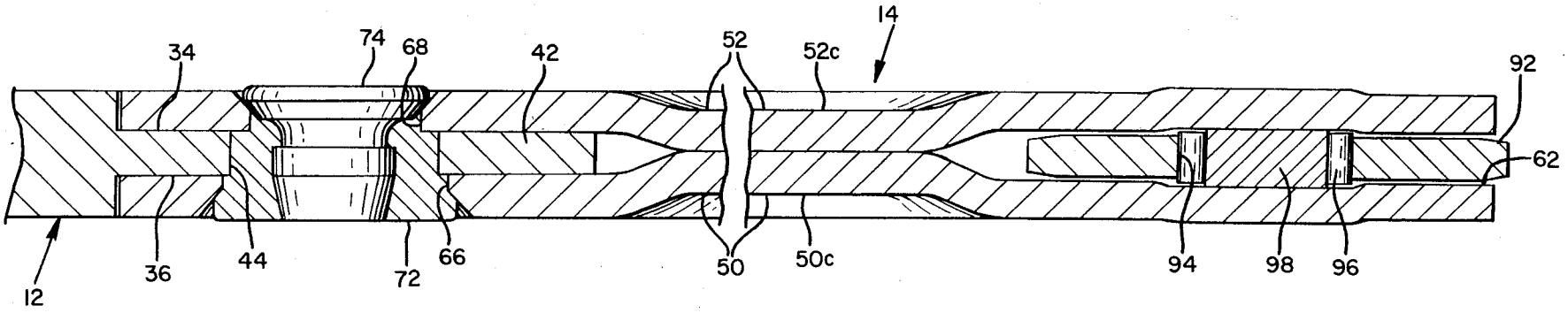
FIG. 5 is an enlarged cross-sectional view taken generally along the line 5—5 in FIG. 1.

As is best seen in FIG. 4, this produces a nose section with a peripheral groove 62 adapted to receive the depending drive tangs of a drive link 28. Groove 62 is substantially aligned with groove 30 in the main bar section when the nose section is assembled to the main body section.

As is also illustrated in FIG. 4, marginal edge portions 50*d*, 52*d* of the plates may be deformed somewhat inwardly toward each other further to control the width of the groove as needed to provide a proper fit for a specific saw chain.

Figure 3:
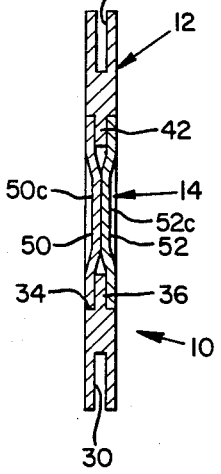
FIG. 3 is a cross-sectional view taken generally along the line 3—3 in FIG. 1.
Figure 6:
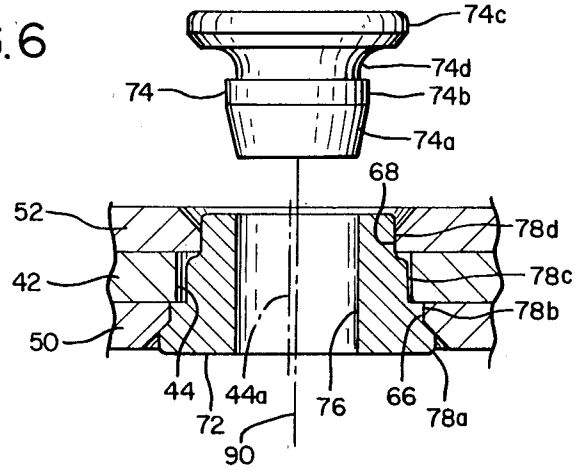
FIG. 6 is an enlarged view of a portion of FIG. 5 with securing means ready for assembly to secure the nose section to the main body section.

Referring to FIG. 3, the embossed, or deformed, central portions of the plates extend rearwardly into tongue portions 50*b*, 52*b* whereby peripheral edge margins thereof are spaced apart a selected distance to snugly receive flange 42. The rear ends of tongues 50*b*, 52*b* have aligned apertures, or bores, 66, 68 defined therethrough. As is seen in FIGS. 5 and 6, bore 66 is somewhat larger than bore 44, whereas bore 68 is somewhat smaller than bore 44, thus providing a set of apertures which decrease in cross-section progressing from one side of the bar to the other.

The assembly is provided with a two-part securing means in the form of a hub member 72 and an expander member 74. The hub member has a central bore 76 extending fully therethrough. The outer surface of the hub member is cylindrical, with a plurality of stepped-down diameter sections 78*a*, 78*b*, 78*c*, 78*d* sized to fit within the previously-defined bores as illustrated in FIG. 6 on assembly.

The stepped diameters of the hub members are concentric, but as will be seen in FIG. 6 and described more fully below, the front side of bore 44 may be closer to section 78*c* than is the rear side of bore 44 on initial insertion of the hub member.

Expander member 74 has a first portion 74*a*, the distal end of which is a smaller diameter than bore 76. Member 74 on progressing from its distal end gradually increases in diameter to a central portion 74*b* of a greater diameter than bore 76. Between portion 74*b* and head 74*c* is a necked-down region 74*d*.

To assemble the guide bar, tongue portions 50*b*, 52*b* are slid into recess regions 34, 36 with flange 42 received in the peripheral groove between the tongue portions. As the nose section is moved almost fully into assembled position as illustrated in FIG. 1, the diverging margin portions at the outer end of the recesses on the bar engage the diverging intermediate portions on the nose section to guide and center the nose section in the bar. Further, with the diverging intermediate portions of the nose section being slightly wider than the diverging peripheral edge margin portions of the recesses the vertical end margins 82, 84 on the nose section stop short of abutment with vertical end margins 86, 88 on the main body section to provide a slight space therebetween. In this position, on initial fit-up, the bores in the tongue sections and flange 42 are positioned as illustrated in FIG. 6, with the center line 44*a* of aperture 44 offset a slight distance rearwardly of the bar from the centerline 90 for hub member 72 and apertures 66, 68. This offset may be on the order of 0.005 inch. Expander member 74 then is driven into hub member 72 to the position illustrated in FIG. 5. On being driven into the hub member the expander member causes the hub member to expand into all of the aligned bores to fill the space therein and tightly secure the sections together. With bore 44 being slightly offset rearwardly of the assembly relative to the bores in the tongue sections, on expansion of the hub member the nose section is drawn more tightly and securely rearwardly into the body section. However, it generally is preferred that vertical end margins 82, 84, 86, 88 remain spaced a slight distance apart whereby the diverging mating surfaces of the main body section and nose section bear the load between the body portion and nose section.

Disassembly of the device is a simple matter. The user merely inserts a somewhat pointed tool into the bore of hub member 76 and drives expander member 74 outwardly therefrom. Although a section of metal from the hub member has been deformed back into necked-down section 74 to clinch the securing members together, the expander member may be driven therefrom with a small amount of metal from the hub member exiting therewith. Once the expander member is removed, the hub member can be driven out from the other side, with its stepped diameters permitting removal.

The forward most portion of plates 50, 52 are spaced apart to receive a sprocket wheel 92. The sprocket wheel has a central bore 94 extending therethrough which is supported on a plurality of roller bearings 96 running on an inner race 98. The inner race is secured between plates 50, 52 by a plurality of rivets 100 extending therethrough.

The main body section and nose section of the assembly are easy to assemble and disassemble adding to the convenience for the user. The embossed, or deformed, plates which are secured together at their embossed sections to define the nose section provide substantial strength and rigidity with a continuous beam effect extending between the nose section and the main body section of the bar. This construction precludes the need for a spacer or third laminate section between the facing plates of the nose section. The diverging edge margins on the recesses in the body section and on the intermediate portion of the nose section act in conjunction with the securing member to provide proper alignment and a secure interconnection between the nose section and main body section. The assembly method and construction allow reliable preloading between the nose section and main body section from one assembly to the next. Further, this assembly is more resistant to loosening during use than previous assemblies.

The hub and expander members used in securing the two sections together provide both ease of assembly and removal. Also, the flow of material of the hub member filling the apertures in the sections provide a secure clinching together of the parts.

Whereas a preferred embodiment of the invention has been described herein, it will be recognized by those skilled in the art that other embodiments and modifications are possible without departing from the spirit of the invention which is set out in the following claim.

I claim:

1. A guide bar for a saw chain comprising an elongate main body section having a rear end attachable to a chain saw motor housing and an outer end space therefrom, a separate nose section, and means for releasably securing said nose section to the outer end of said body section, said body section having opposed peripheral edges with elongate grooves defined therein for receiving the drive tangs of a saw chain to guide the chain along the bar, the outer end portion of said main body section has a selected width between said peripheral edges, recesses are defined in opposed faces thereof, an opening extends inwardly from the outer end of said main body section within the region of said recesses, and a central portion of said main body section between said recesses defines a flange paralleling the plane of said body section and extending about said opening, said nose section comprising a pair of opposed facing plates, at least one of said plates having a central portion thereof spaced inwardly from edge margins of the plate deformed laterally toward the other of said plates from the plane of remainder portions of said one plate, and means securing said plates together with said deformed central portion of said one plate abutting an inwardly facing surface of the other plate to space edge portions of said plates apart a selected distance to provide grooves along edge margin portions of said nose sections generally aligned with the grooves in said body portion to receive the drive tangs of such chain, said plates of the nose section having bar nose portions of a width generally equal to the width of said outer end of the main body section and narrower tongue portions which project rearwardly from said bar nose portions with outlines complementing said recesses in the opposite faces of said main body section for receipt therein, and the deformed central portion of a plate extends rearwardly into said tongue region of at least one of said plates and is of an outline complementary to said opening between said recesses to be received therein with edge margins of said tongues engaging opposite sides of said flange, and wherein opposed peripheral edge margins of said recesses in said body portion diverge on progressing toward the outer end of said body section and said plates of said nose section have edge margin portions intermediate said tongue and nose portions which diverge at an angle complementary to the angle of divergence of the peripheral edges of said recesses but are slightly wider, said diverging edge margin portions of said nose section being positined to bear against the diverging edge margins of said body section when assembled to aid in aligning said nose section relative to said body section.

2. A guide bar for a saw chain comprising an elongate main body section having a rear end attachable to a chain saw motor housing and an outer end spaced therefrom, a separate nose section, and means for releasably securing said nose section to the outer end of said body section, said body section having opposed peripheral edges with elongate grooves defined therein for receiving the drive tangs of a saw chain to guide the chain along the bar, said nose section comprising a pair of opposed facing plates, at least one of said plates having a central portion thereof spaced inwardly from edge margins of the plate deformed laterally toward the other of said plates from the plane of remainder portions of said one plate, and means securing said plates together with said deformed central portion of said one plate abutting an inwardly facing surface of the other plate to space edge portions of said plates apart a selected distance to provide grooves along edge margin portions of said nose section generally aligned with the grooves in said body portion to receive the drive tangs of such chain, with rearwardly projecting portions of said nose section being positioned on opposite sides of and overlapping a central portion of said main body section when assembled, and substantially aligned apertures extending through said rearwardly projecting portions and main body section with the apertures decreasing in cross section on progressing from the plate on one side, through the body section, and through the other plate on the opposite side of the body section, and said means for securing said nose section to the outer end of the body section comprises a hub member having an external configuration for receipt in said apertures, the external configuration of said hub member having a first portion of a cross section sized to fit into the minimum cross sectional aperture in said other plate, a second portion of a cross section larger than said first portion but of a cross section sized to fit within said aperture in said main body section, and a third portion of a cross section greater than the cross section of said second portion but of a size to fit within the aperture in the largest cross section aperture of the one nose plate, said hub member further having an opening extending laterally inwardly from one end thereof, and which further comprises an expander member capable of being driven into said opening in said hub member, said expander member having a first portion of a cross section smaller than said opening to permit initial insertion into said opening and a second portion of greater cross section, operable on being driven into said opening to expand said hub member in said apertures to lock said sections together.

3. The guide bar of claim 1, wherein said flange has an aperture extending therethrough adjacent the rearward end of said recesses and said tongue portions of said plates overlap said aperture and have apertures extending therethrough generally aligned with said aperture in said flange, but slightly offset forwardly from said aperture in said flange upon initial fit-up, whereby when said fastening member is received therein it draws said diverging margins of said recesses and the nose sections tightly together.

4. A guide bar for a saw chain comprising an elongate main body section having a rear end attachable to a chain saw motor housing and an outer end spaced therefrom, a separate nose section, and means for releasably securing said nose section to the outer end of said body section, said body section having opposed peripheral edges with a selected width therebetween and elongate grooves defined therein for receiving the drive tangs of a saw chain to guide the chain along the bar, the outer end portion of said main body section having outer end margins and recesses defined in opposed side faces thereof, an opening extends inwardly from the outer end margins of said main body section within the region of said recesses, and a central portion of said main body section between said recesses defining a flange paralleling the plane of said body section and extending about said opening, said nose section having end margins and a width generally equal to the width of said outer end of said main body section with grooves along edge margin portions thereof generally aligned with the grooves in said body portion to receive the drive tangs of such chain, and a narrower tongue portion which projects rearwardly from said bar nose portion with an outline complementing said recesses in the opposite faces of said main body section for receipt therein and a groove defined in the outer edge of said tongue portion to receive said flange, and opposed peripheral edge margins of said recesses in said body portion diverge progressively outwardly toward the outer end margins of said body section and said nose section has edge margin portions intermediate said tongue and nose portions which diverge at an angle complementary to the angle of divergence of the peripheral edges of said recesses but are slightly wider, said diverging edge margin portions of said nose section being positioned to bear against the diverging edge margins of said body section when assembled to aid in aligning said nose section relative to said body section.

5. The guide bar of claim 4, wherein said flange has an aperture extending therethrough adjacent the rearward end of said recesses and said tongue portion of said nose section overlaps said aperture and has an aperture extending therethrough generally aligned with said aperture in said flange, but slightly offset forwardly from said aperture in said flange upon initial fit-up, whereby when said fastening member is received therein it draws said diverging margins of said recesses and the nose section tightly together.

6. The guide bar of claim 5, wherein said fastening member comprises a hub member having an external configuration generally complementing the configuration of said apertures for receipt therein and an opening extending laterally inwardly from one side of said bar, and which further comprises an expander member capable of being driven into said opening in said hub member, said expander member having a first portion with a cross section smaller than said opening to permit initial insertion into said opening and a second portion of greater cross section operable, on being driven into said opening, to expand said hub member in said apertures to lock said sections together.

7. The guide bar of claim 18, wherein said aperture in said tongue portion is slightly offset forwardly from said aperture in said flange, upon initial fit-up, whereby when said expander member is driven into the opening in said hub member to expand said hub member the nose section is urged rearwardly into closer engagement with said body section.

8. The guide bar of claim 2, wherein on initial fit-up the center line of the aperture in the body section is offset longitudinally of the bar from the center line of the apertures in the nose portion, and expansion of the hub member upon driving of the expander member therein is operable to urge the nose and body section toward positions in which said center lines are more nearly coincident.

* * * * *